US009693629B2

(12) United States Patent
Susnjara

(10) Patent No.: US 9,693,629 B2
(45) Date of Patent: Jul. 4, 2017

(54) METHOD OF INSTALLING A DRAWER IN A CABINET

(71) Applicant: Thermwood Corporation, Dale, IN (US)

(72) Inventor: Kenneth J. Susnjara, Birdseye, IN (US)

(73) Assignee: Thermwood Corporation, Dale, IN (US)

( * ) Notice: Subject to any disclaimer, the term of this patent is extended or adjusted under 35 U.S.C. 154(b) by 383 days.

(21) Appl. No.: 14/276,476

(22) Filed: May 13, 2014

(65) Prior Publication Data

US 2015/0327677 A1 Nov. 19, 2015

(51) Int. Cl.
*A47B 88/00* (2017.01)
*A47B 88/423* (2017.01)
*A47B 88/43* (2017.01)

(52) U.S. Cl.
CPC ..... *A47B 88/423* (2017.01); *A47B 88/43* (2017.01); *Y10T 29/49842* (2015.01)

(58) Field of Classification Search
CPC ..... A47B 88/0418; A47B 88/044; Y10T 29/49842
See application file for complete search history.

(56) References Cited

U.S. PATENT DOCUMENTS 5,457,867 A * 10/1995 Maberry ..... A47B 88/044 29/525
7,967,402 B2 * 6/2011 Hoshide ..... A47B 88/047 312/319.1

* cited by examiner

*Primary Examiner* — Richard Chang
(74) *Attorney, Agent, or Firm* — Bookoff McAndrews, PLLC

(57) ABSTRACT

A method of installing a drawer in a compartment of a structure including inserting a set of pins in pin holes provide in spaced walls of such compartments; positioning a drawer support assembly including a track member and a cooperable slide member on each side wall with each track member seated on a set of pins and connected to a side wall, and a slide member displaceable relative to said track member; displacing bending ends of the slide members equal distances beyond such compartment; inserting the drawer between such extended slide members, seated in such pins; fasting leading ends of the slide members to the drawer; incrementally further withdrawing such drawer from the compartment; and fastening the side members to adjacent side wall of the drawer upon having further drawn the drawer incrementally.

6 Claims, 4 Drawing Sheets

METHOD OF INSTALLING A DRAWER IN A CABINET

The present invention relates to a method of installing a drawer in a cabinet and more particularly to such a method which provides for a precise installation of such drawer by a comparatively unskilled worker in a minimal amount of time. The invention further provides for the use of a suitably programmed CNC router in the machining of cabinet panels on which such drawers are mounted, assuring a proper posturing and alignment of such drawers.

BACKGROUND OF THE INVENTION

In the manufacture of cabinets for residential, commercial and other use, there typically is provided one or more sets of assemblies mounted on side walls of drawer compartments, on which the drawers are mounted and permitted to be displaced into and out of such compartments. Such functionality requires that such assemblies be disposed in a common plane with the track components thereof suitably secured to the side walls of the drawer compartments and the slide components thereof suitably secured to the drawers, freely permitting the drawers to be displaced. In the prior art, a certain amount of skill has been required to suitably install such drawers in a timely and suitable manner.

In view of the foregoing, it is the principal object of the present invention to provide a method for installing a drawer in a cabinet compartment in a suitable and timely manner by an assembler of comparatively less skill than previously required. A further object of the invention is to provide a method as described in which a suitably programmed CNC router may be used to provide means on opposed panels of a cabinet compartment in which a drawer is to be installed, providing a proper alignment of the drawer installed and facilitating the installation of the drawer by a comparatively unskilled assembler.

SUMMARY OF THE INVENTION

The principal objective of the present invention is achieved by a method of installing a drawer in a compartment of a structure partially defined by a pair of spaced wall members each provided with a set of pin holes disposed in a common plane comprising inserting a set of pins into such pin holes with end portions thereof protruding into such compartment; positioning a drawer support assembly including a track member and a cooperable slide member on each of the spaced side wall members with each of the track members seated on protruding portions of one of the set of pins and connected to an adjacent side wall member, and the cooperable slide members displaceable relative to such track member; displacing leading ends of the slide members relative to the track members thereof, equal distances beyond the compartment; inserting the drawer between the slide members, resting on the protruding portions of the inserted sets of pins; fastening the leading ends of the slide members to laterally adjacent side walls of the drawer; incrementally withdrawing the drawers with the initially fastened slide members from the compartment; and further fastening the slide members to the laterally adjacent side walls of the drawer upon withdrawing the drawer incrementally.

In the preferred embodiment of the invention the pin holes accommodating the support pins are formed on a CNC router suitably programmed, on panels assembled in a structure, partially defining the compartment in which the drawer is to be installed. Such positioning holes may be formed in conjunction with other machining functions being performed on such panels. Typically, such positioning holes would be formed relative to a certain feature of the panel such as an edge thereof. A single or multiple sets of such pin holes may be machined depending on the particular configuration of the intended structure.

In a further embodiment of the invention, each drawer support assembly may include a first slide segment displaceable relative to a cooperating track member, a second slide segment displaceable relative to such first slide segment with the drawer mounted on such second slide members provided with means for detachably connecting the drawer thereto.

BRIEF DESCRIPTIONS OF THE DRAWINGS

DETAILED DESCRIPTION OF THE PREFERRED EMBODIMENTS OF THE INVENTION

Figure 1:
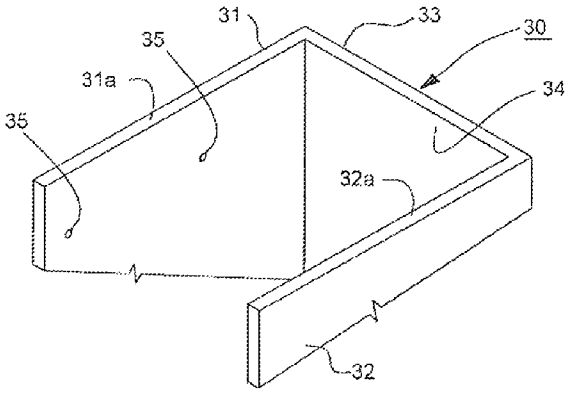
FIG. 1 is a perspective view of a portion of a structure providing a compartment in which a drawer may be installed, illustrating a set of pin holes precisionally located in one of the side walls of the compartment, having portions thereof broken away.
Figure 2:
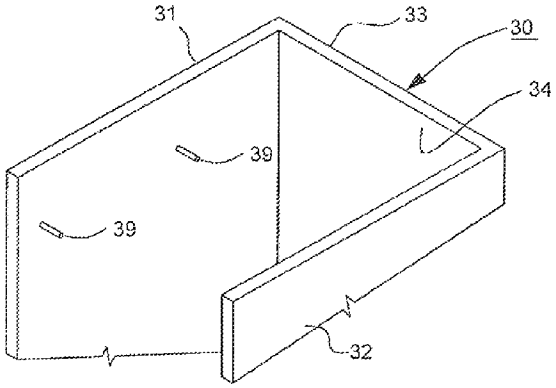
FIG. 2 is a view similar to the view shown in FIG. 1, in which support pins are shown inserted in the pin holes shown in FIG. 1.
Figure 3:
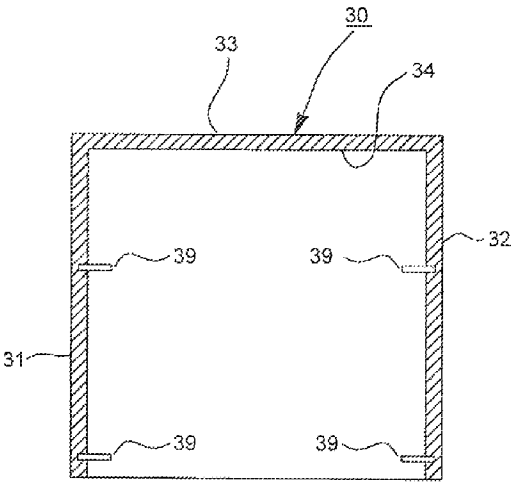
FIG. 3 is a horizontal section of the assembly shown in FIGS. 1 and 2, illustrating sets of support pins inserted in spaced holes of opposed side wall panels.
Figure 4:
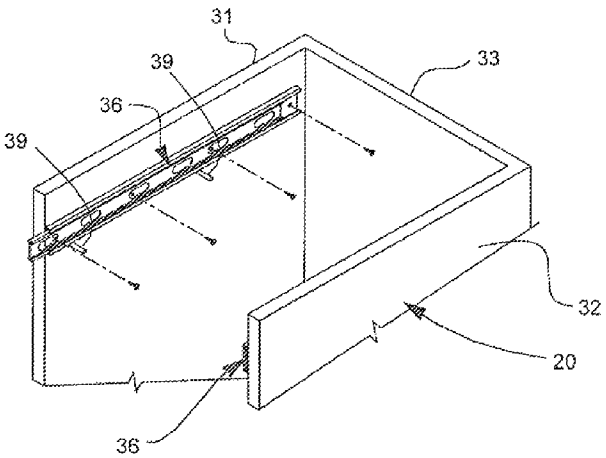
FIG. 4 is a perspective view of the drawer shown in FIGS. 1 through 3 provided with drawer support assemblies seated on the sets of support pins thereof and connected to opposing side wall panels.
Figure 6:
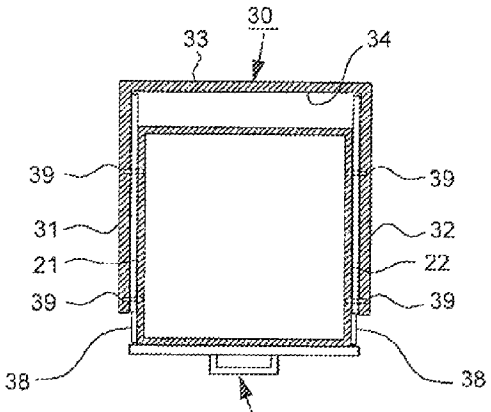
FIG. 6 is a cross-sectional view of the structure partially defining the drawer component with the slide members of the drawer support assemblies partially withdrawn from the compartment with the drawer resting on sets of support pins and the leading ends of the slide members secured to sides of the drawer.
Figure 7:
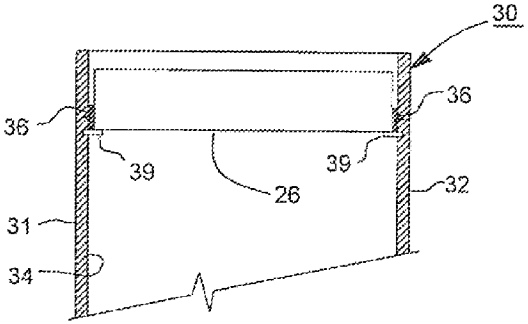
FIG. 7 is a vertical view sectional view of the structure shown in FIGS. 1 through 6, illustrating the drawer inserted in the compartment thereof.
Figure 9:
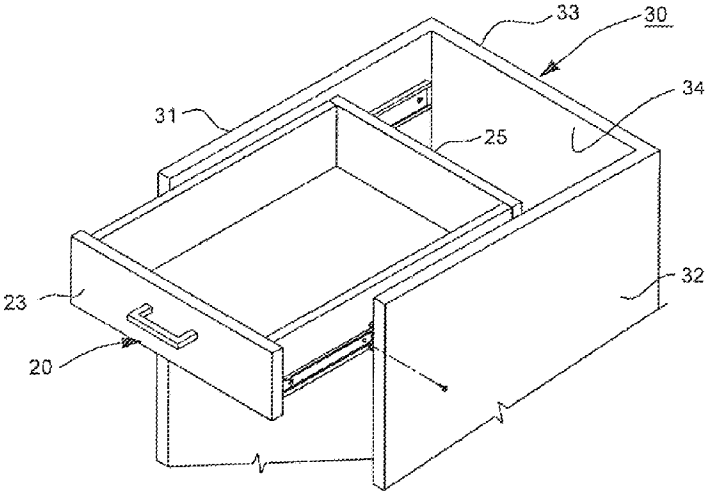
FIG. 9 is a view similar to the view shown in FIG. 8, with the drawer withdrawn further from the compartment.
Figure 10:
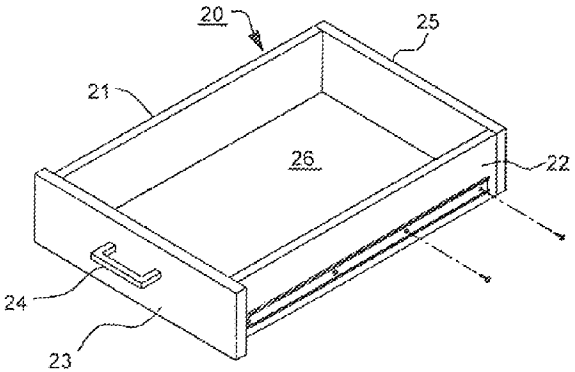
FIG. 10 is a perspective view of the drawer shown in FIGS. 8 and 9 fully withdrawn from the compartment.

Referring to FIGS. 1 through 10 of the drawings, there is illustrated a manner in which a drawer 20 may be installed in a compartment of a cabinet structure 30. As best seen in FIGS. 9 and 10, drawer 20 includes a pair of side walls 21 and 22, a front wall 23 provided with a handle 24, a rear wall 25 and a bottom wall 26, and the cabinet structure includes a pair of laterally spaced walls 31 and 32 displaced a distance slightly greater than the spacing between the outer sides of drawer sides 21 and 22 providing small spaces therebetween, and a rear wall 33, defining a drawer compartment 34. Either prior to or upon attachment of rear wall panel 33 to side wall panels 31 and 32, sets of pin holes 35,35 are partially formed on the inner sides of cabinet structures aide walls 31 and 32 which will lie in a common plane when the compartment forming structure is assembled. Typically, such plane would be disposed perpendicular to wall panels 31 and 32 and vertically positioned to permit the insertion and installation of a drawer 20. As shown in FIG. 1, the plane of such sets of pin holes 35 is spaced from and substantially parallel to upper edges 31*a* and 32*a* of structure side wall panels 31 and 32. Preferably, such pin holes are formed by a suitably programmed CNC machine and particularly by a CNC router when possibly machining panels 31 and 32.

Upon availability of the sets of pin holes in the sides of structure panels 31 and 32, either before or after the assembly of the structure defining compartment 34, a pair of drawer support assemblies 36, 36 may be positioned on and secured on the inner sides of wall panels 31 and 32. Each of such assemblies includes an elongated track member 37 and an elongated slide member 38. The track member is formed of a planer segment with fastener holes and curved end segments along the length thereof. The slide member is mounted on the track member, guided between the curved end segments of the track member, and also is provided with a number of longitudinally spaced fastener receiving holes.

To install drawer 20 into compartment 34, a set of pins 39 are first inserted in pin holes 35 with end portions thereof protruding into compartment 34. Each assembly 36 is then mounted on the inner ends of a set of pins 39 with a curved end segment of a track member seated on the set of pins and the planar segment thereof positioned against a side wall 31 or 32. The track member of such assembly is then secured to the adjacent panel by means of a set of threaded fasteners screwed through openings in the planar segment of the track member into the adjacent panel.

Figure 5:
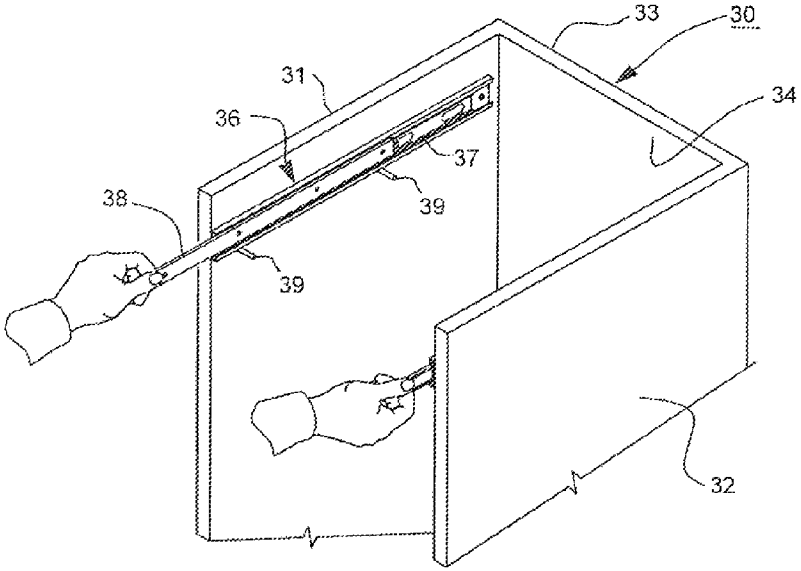
FIG. 5 is a view similar to the view shown in FIG. 4, illustrating the manner in which the slide members of the drawer support assemblies are withdrawn to position the slide members for installing and attaching a drawer therebetween.
Figure 8:
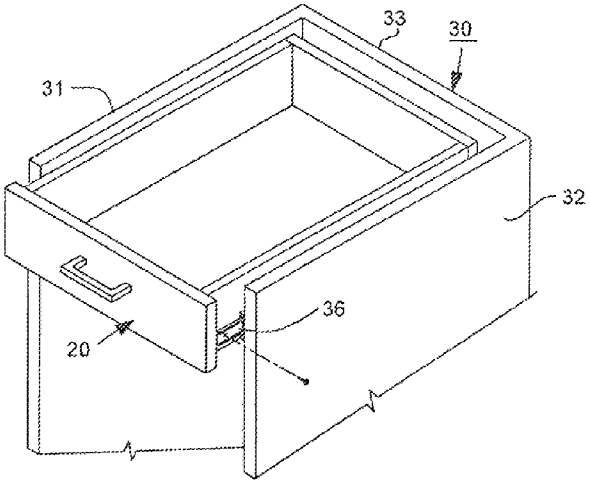
FIG. 8 is a perspective view of a drawer seated on opposed sets of support pins within the compartment, partially withdrawn from the compartment.

Once such assemblies have been mounted on the inner sides of structure panels 31 and 32 within compartment 34, the leading ends of slide member 38,38 are withdrawn from compartment 34, positioning a first of a set of fastener openings therein beyond compartment 34, as shown in FIG. 5. With such leading ends of the slide members thus partially withdrawn, drawer 20 is inserted into compartment 34 between slide members 38,38 and seated on the outer ends of pins 39 with the outer ends of the side walls of the drawer being laterally aligned with the leading ends of the slide members. With the drawer and slides thus positioned, threaded fasteners are inserted through the openings in the outer leading ends of the slide members into the side panels of the drawer, as shown in FIG. 8, to secure the leading ends of slide members 38,38 to the uninserted ends of side walls 21 and 22 of the drawer. With the slide members thus partially connected to the drawer and the drawer continued to be partially seated on pins 39, the drawer is withdrawn incrementally to provide access to additional openings in the slide member, permitting additional fasteners to be inserted through such openings and screwed into the side walls of the drawer. Such fastening procedure is then repeated to obtain access to additional openings in the slide members, permitting additional fasteners to be inserted. As the drawer is thus being withdrawn from the compartment with the drawer at least partially fastened to the slide members, it will be suitably aligned along its intended line of travel by means of being solely mounted on such pins, partially secured the said slide member and partially mounted on such pins or totally fastened on the slide members. As such partially attach drawer is withdrawn incrementally from the compartment, additional fasteners may be applied as shown in FIG. 9.

Figure 11:
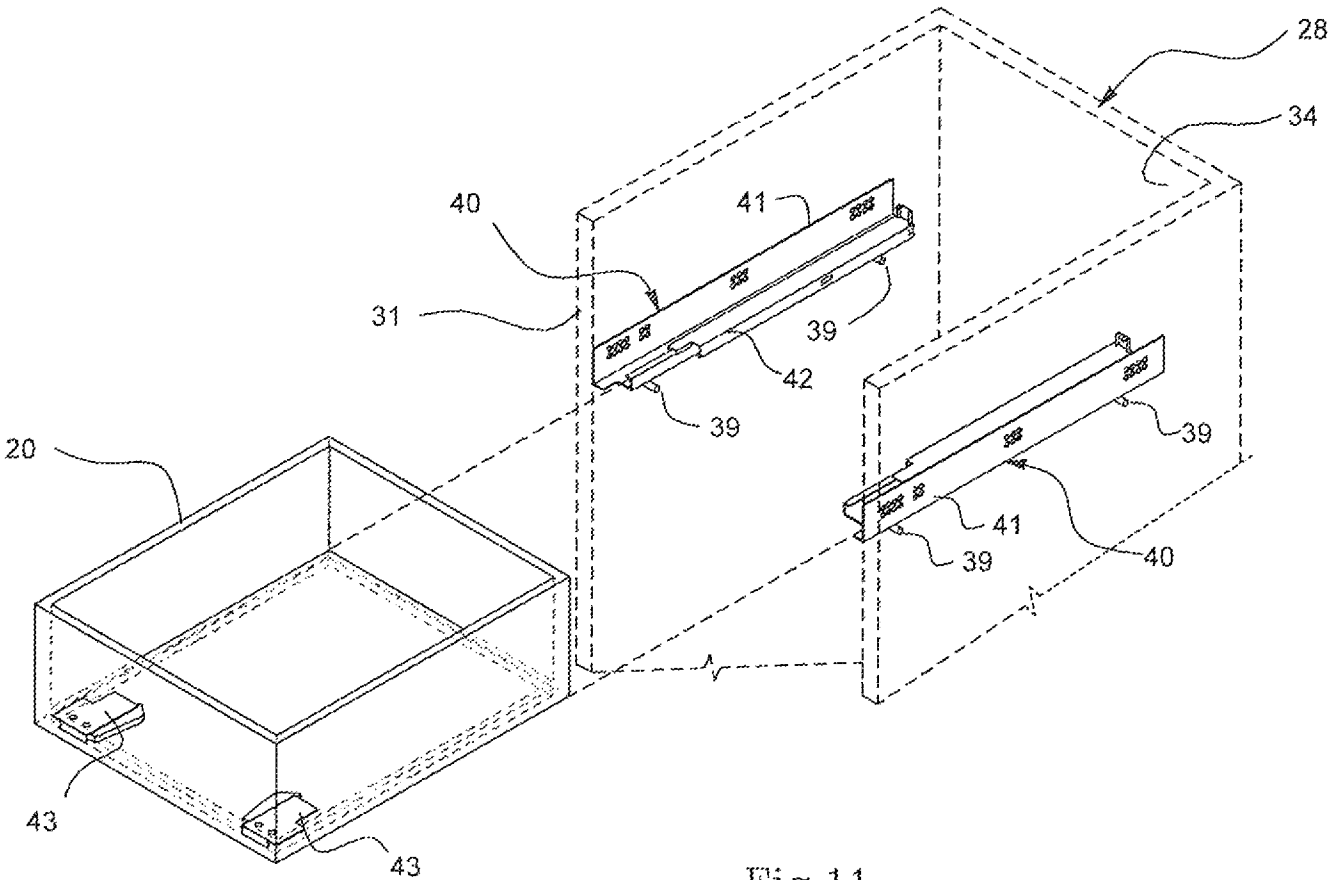
FIG. 11 is a perspective view of another embodiment of the invention, illustrating the drawer aligned with and removed from the drawer compartment of the structure.

A variation of the method as described may be practiced with a different set of drawer support assemblies as shown in FIG. 11. Each of such assemblies 40,40 includes a track member 41 seated on a set of support pins 39,39 and a slide member 42 displaceably mounted on track member 41 having a leading end portion thereof detachably connected to an aligned cooperating member 43 mounted on the underside of a drawer 20 adjacent a side wall thereof. Each track member 41 is provided with a generally u-shaped cross-sectional configuration including an elongated web segment seated on a set of support pins 39,39, a first leg segment secured to an inner side of a side panel 31 or 32 and a spaced second leg segment spaced from a fastened leg segment. Slide 42 includes a first component displaceably mounted on a second leg segment of a track member and a second component displaceably mounted on the first component thereof and detachably connected at an end thereof to one of members 43,43.

A drawer 20 may be installed on structural component 30 by inserting the rear end of drawer 20 into compartment 34, resting on the second slide component of slide 42 and causing the leading end of such second slide component to engage and thus connect to a member 43. At all times that the drawer is resting upon the second slide component connected to member 40, the drawer may be freely inserted into and withdrawn out of compartment 34. When desired to be removed from compartment 34, the drawer need merely to be disconnected from slides 42,42 and withdrawn.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

I claim:

1. A method of installing a drawer in a compartment of a structure, the structure being partially defined by a pair of spaced side wall members, each side wall member provided with a set of pin holes disposed in a common plane, the method comprising:

inserting a pin into each pin hole of said set of pin holes in each side wall member, wherein an end portion of each pin protrudes into said compartment when the pin is inserted into a respective pin hole;

positioning a drawer support assembly adjacent to each spaced side wall member, wherein each drawer support assembly includes a track member and a cooperable slide member, and wherein a first segment of a track member of each drawer support assembly is supported on one or more pins and a second segment of the track member is fastened to a respective side wall member, wherein the second segment of the track member is formed integrally with and parallel to the first segment of the track member;

seating said drawer on each slide member of each drawer support assembly; and detachably connecting a latching device mounted on an underside of said drawer to each slide member.

2. The method of claim 1 including forming said set of pin holes in each side wall member prior to assembling the side wall members as part of said structure.

3. The method of claim 2 including forming said set of pin holes in each side wall member by means of a suitably programmed CNC machine.

4. The method of claim 1 including forming said set of pin holes in each side wall member upon partial assembly of said structure so as to provide sufficient access to said side wall members.

5. The method of claim 1 including securing each track member to each respective side wall member via one or more fasteners inserted through openings in said track member.

6. The method of claim 1, wherein the second segment of the track member is fastened to the respective side wall member via one or more threaded fasteners inserted through openings in said second segment.

* * * * *